US010145619B2

(12) United States Patent
Huang et al.

(10) Patent No.: US 10,145,619 B2
(45) Date of Patent: Dec. 4, 2018

(54) HEAT PIPE

(71) Applicant: DELTA ELECTRONICS, INC., Taoyuan (TW)

(72) Inventors: Shih-Lin Huang, Taoyuan (TW); Chiu-Kung Chen, Taoyuan (TW); Sien Wu, Taoyuan (TW); Ti-Jun Wang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 15/783,300

(22) Filed: Oct. 13, 2017

(65) Prior Publication Data

US 2018/0038659 A1 Feb. 8, 2018

Related U.S. Application Data

(62) Division of application No. 14/704,218, filed on May 5, 2015, now abandoned.

(30) Foreign Application Priority Data

Jan. 9, 2015 (CN) ..... 2015 1 0011351

(51) Int. Cl.
*F28D 15/02* (2006.01)

(52) U.S. Cl.
CPC ..... *F28D 15/02* (2013.01); *F28D 15/025* (2013.01)

(58) Field of Classification Search
CPC ..... F28D 15/025; F28D 15/0266; F28D 15/0233; F28D 1/0471; F28D 15/02
See application file for complete search history.

(56) References Cited

U.S. PATENT DOCUMENTS

| | | | | |
|---|---|---|---|---|
| 4,020,898 | A | 5/1977 | Grover | |
| 4,036,291 | A | 7/1977 | Kobayashi | |
| 4,961,463 | A | 10/1990 | Denhartog | |
| 5,036,908 | A | 8/1991 | Petroff | |
| 6,148,906 | A | 11/2000 | Li | |
| 6,725,910 | B2 * | 4/2004 | Ishida | B21C 37/151 165/104.21 |
| 7,543,630 | B2 | 6/2009 | Lai | |
| 2001/0047859 | A1 | 12/2001 | Ishida | |
| 2009/0260790 | A1 * | 10/2009 | Wang | B23P 15/26 165/177 |

FOREIGN PATENT DOCUMENTS

| | | | | |
|---|---|---|---|---|
| CN | 1955628 | A | 5/2007 | |
| GB | 2072324 | A * | 9/1981 | F28D 15/025 |
| JP | WO 2010117092 | A1 * | 10/2010 | F28D 15/025 |

* cited by examiner

*Primary Examiner* — Tho V Duong
(74) *Attorney, Agent, or Firm* — Muncy, Geissler, Olds & Lowe, P.C.

(57) ABSTRACT

A heat pipe is disclosed in the present invention. The heat pipe includes a first pipe and at least a second pipe. The first pipe is formed with an enclosed space. The second pipe is disposed in the enclosed space. There is no wick structure disposed between the first pipe and the second pipe.

2 Claims, 6 Drawing Sheets

HEAT PIPE

CROSS REFERENCE TO RELATED APPLICATIONS

This application is a Divisional of co-pending application Ser. No. 14/704,218 filed on May 5, 2015, which claims priority to 201510011351.7 filed in People's Republic of China on Jan. 9, 2015, the entire contents of which are hereby incorporated by reference.

BACKGROUND OF THE INVENTION

Field of Invention

The invention is relative to a heat pipe, especially relative to a heat pipe utilizing vapor pressure difference to drive working fluids.

Related Art

A heat pipe of prior art is mainly composed of a closed metal tube, a wick structure and heat transferring fluid filled in the metal tube. An appropriate vacuum degree in the metal tube is maintained for reducing the starting temperature difference of heat pipe. The evaporator of the heat pipe is located at the heat source, and the fluid in the metal tube absorbing the heat generated by the heat source can be evaporated to a vapor. The vapor is flowed to the condenser of the heat pipe according to the difference of the vapor pressure. Then the vapor will be condensed as liquid fluids at the condenser of the heat pipe by heat dissipation. The fluids will be flowed back to the evaporator of the heat pipe according to the wick structure. Thus, the heat of heat pipe can be transferred efficiently by the above structure.

Since the heat pipe structure is simple and has a high conductivity, low thermal resistance, the heat pipe had been applied in electronic industry or other heat dissipation fields. Because the electronic devices are developed as the portable electronics applications, lighter and thinner device, 4K video, 4G transmission, and high added functionality. The heat generated by the electronic device is getting higher according to advance of the electronic devices. The heat pipe of the prior art can not satisfy the demand for dissipating a lot of heat of heat and high heat flux. Thus the performance of the heat pipe should be improved. For instance, the manufacturing method of the wick structure should be improved, and the composite wick structure for enhancing the capillary force of the wick structure is utilized. However, these improving methods require complicated procedures and lengthy time, and the configuration of the heat pipe is still too complex to be taking into account the costs and effects of the heat pipe.

Furthermore, when the heat pipe of the prior art is in operation, the direction of the vapor is opposite to the direction of the working fluids. The vapor and the working fluids are not separated. The working fluids should be overcome the resistance of the vapor flow and then returned to the evaporator of the heat pipe for next cycle. The heat pipe should meet the capillary limitation for the continuously dynamic cycle (the internal capillary force must be greater than total force of the vapor pressure, and other fluid reflux resistance and gravity forces).

Therefore, it is an important subject to provide a simple structure heat pipe provided for increasing the heat transferring capacity, high-efficient heat dissipation and high heat flux of the electronic device.

SUMMARY OF THE INVENTION

In view of foregoing subject, an objective of the present invention is to provide a heat pipe with simple structure for increasing heat flux and effectively solving the request of the high-efficient heat dissipation and high heat flux.

For achieving the above objective, a heat pipe according to the present invention includes a first pipe and at least one second pipe. The first pipe is formed with an enclosed space. The second pipe is disposed in the enclosed space. No wick structure is disposed at an interior of the second pipe. No wick structure is disposed between the first pipe and the second pipe.

In one embodiment, the second pipe includes two ends along an axial direction, and a middle part between the two ends. A cross-sectional area of one of the two ends is larger than that of the middle part.

In one embodiment, the second pipe comprises two ends along an axial direction, and a middle part between the two ends. A cross-sectional area of one of the two ends is smaller than that of the middle part.

For achieving the above objective, a heat pipe according to present invention includes a first pipe and at least one second pipe. The first pipe is formed with an enclosed space. No wick structure is disposed at an inner sidewall of the first pipe. At least one second pipe disposed in the enclosed space. No wick structure disposed at an exterior sidewall of the second pipe.

In one embodiment, the second pipe includes two ends along an axial direction, and a middle part between the two ends. A cross-sectional area of one of the two ends is larger than that of the middle part.

In one embodiment, the second pipe includes two ends along an axial direction, and a middle part between the two ends. A cross-sectional area of one of the two ends is smaller than that of the middle part.

For achieving the above objective, a heat pipe according to present invention includes a first pipe. The first pipe is formed with an enclosed space and no wick structure disposed at an inner sidewall of the first pipe. A part of sidewall of the first pipe is deformed to define a first section and a second section. The second section includes a first opening and a second opening. The first opening and the second opening are communicated with the first section, respectively.

In one embodiment, the second section includes two ends along an axial direction, and a middle part between the two ends. A cross-sectional area of one of the two ends is larger than that of the middle part.

In one embodiment, the second section includes two ends along an axial direction, and a middle part between the two ends. A cross-section area of one of the two ends is smaller than that of the middle part.

In one embodiment, a size of the second section is smaller than that of the first section.

According to above, the heat pipe of the present invention includes a first pipe and a second pipe disposed in the first pipe. Due to simple structure for easy manufacturing, the quality and the yield of the manufacturing of the heat pipe can be increased and the cost can be decreased. Additionally, the heat pipe of the present invention with inner pipe and outer pipe can improve the efficiency of the liquid-gas cycle in the heat pipe and the heat conducting ability of the heat pipe. The heat pipe of the present invention is especially for avoiding the transient heat shock and providing a solution for high-efficient heat dissipation and high heat flux.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

A heat pipe according to a preferred embodiment of the present invention will be apparent from the following detailed description, which proceeds with reference to the accompanying drawings, wherein the same references relate to the same elements.

Figure 1A:
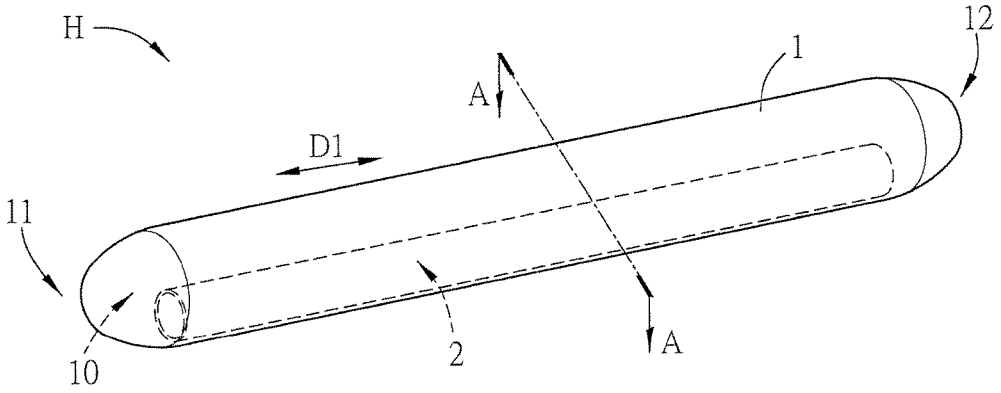
FIG. 1A is a schematic view of partial heat pipe according to a preferred embodiment of the present invention.
Figure 1B:
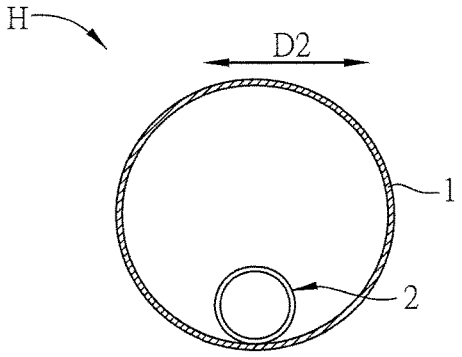
FIG. 1B is a cross-sectional view taken along line A-A of the heat pipe in FIG. 1A.

FIG. 1A is a schematic view of partial heat pipe according to a preferred embodiment of the present invention. FIG. 1B is a cross-sectional view taken along line A-A of the heat pipe in FIG. 1A. In the embodiment, a heat pipe H includes a first pipe 1 and at least one second pipe 2. In the embodiment, one second pipe is 2 is utilized. The first pipe 1 is formed with an enclosed space 10. The second pipe 2 is disposed in the enclosed space 10. There is no wick structure disposed between the first pipe 1 and the second pipe 2.

In the embodiment, the first pipe 1 is an elliptic cylindrical pipe with a thin wall. A section taken along a radial direction of the first pipe is a uniform section. The first pipe 1 can be made of Cu, Ag, Al, an alloy combined by those or other metals with good heat efficiency. In actual application, except for the second pipe 2 disposed in the first pipe 1, a plurality of working fluids (not shown) is also disposed in the first pipe 1. The working fluids can be a fluid for easily evaporated by heat. The working fluids can be inorganic compounds, alcohols, ketones, liquid metal, Freons, organic compounds or mixtures thereof. Furthermore, the shape, the size of the first pipe 1 is not limited to that shown in figures. For instance, the first pipe 1 can be a cylindrical tube or a rectangular tube. The ends of the first pipe 1 are determined by environment, space, heat conductivity and temperature.

Figure 1C:
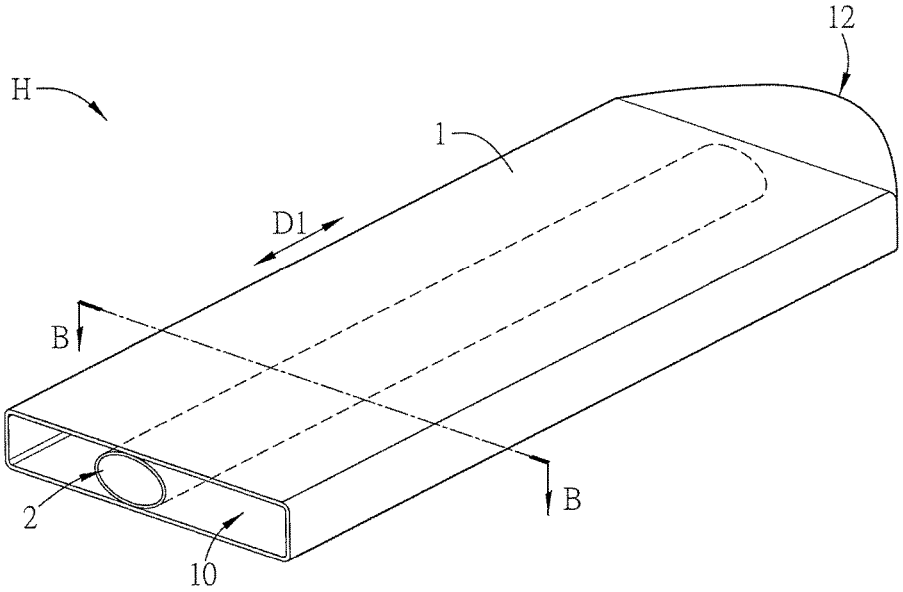
FIG. 1C is a schematic view of the flattened heat pipe in FIG. 1A.
Figure 1D:
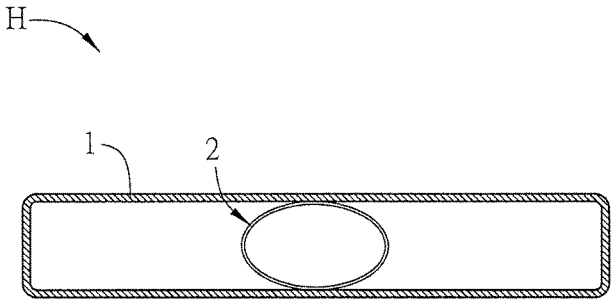
FIG. 1D is a cross-sectional view taken along line B-B of the heat pipe as shown in FIG. 1C.

FIG. 1C is a schematic view of the flattened heat pipe in FIG. 1A. FIG. 1D is a cross-sectional view taken along line B-B of the heat pipe as shown in FIG. 1C. The forming method of the heat pipe H of the embodiment is that the second pipe 2 is disposed in the first pipe 1. After the working fluids are injected, the first pipe will be evacuated and the heat pipe H is manufactured accordingly. Then the first pipe 1 and the second pipe 2 will be flattened. Another processing is firstly evacuating and then injecting the working fluids. In other words, two ends 11, 12 disposed along a radial direction the first pipe 1 of the heat pipe H are enclosed to form the enclosed space 10.

Figure 1E:
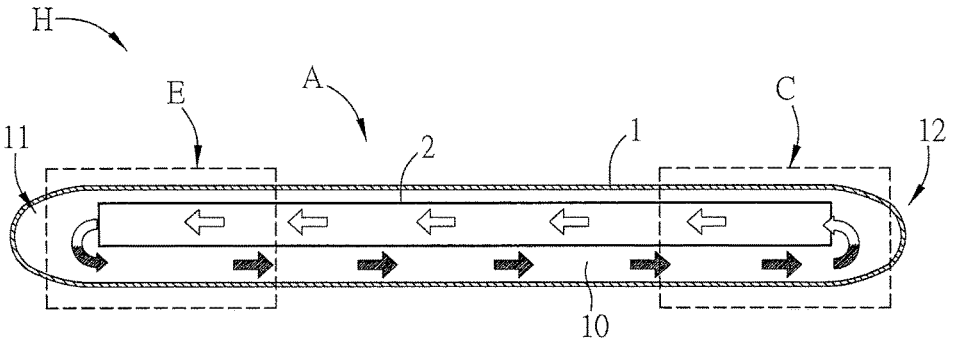
FIG. 1E is a side sectional view of the heat pipe in FIG. 1A.
Figure 1F:
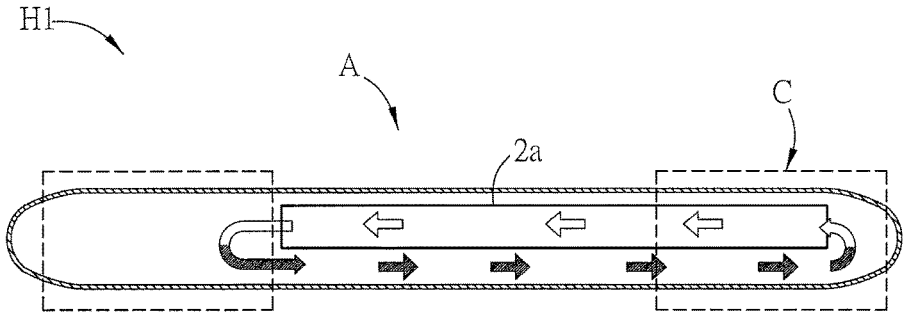
FIG. 1F is a side sectional view of the heat pipe of the additional embodiment of the present invention.

Referring to FIG. 1E, the first pipe 1 includes an evaporating part E, a heat insulation part A and a condensing part C. The evaporating E, the heat insulation part A and the condensing part C are communicated with each other and cooperatively define the enclosed space 10. The evaporating part E and the condensing part C are respectively closer the two ends 11, 12 of the first pipe 1. The heat insulation part A is disposed between the evaporating part E and the condensing part C. Areas of the heat insulation part A and the condensing part C shown in FIG. 1E are just for understanding, and not limited to those in FIG. 1E. In the embodiment, the second pipe 2 are located at an area including a part of the evaporating part E, a part of the condensing part C and all the heat insulation part A. In the other embodiment (referring to FIG. 1F), the second pipe 2*a* of the heat pipe H1 is just located at an area including a part of the condensing part C and all the heat insulation part A.

In actual application, an end located at a heat source is the evaporating part E. Another end far away form the heat source is the condensing part C of the heat pipe H. In the heat dissipation process, the working fluids closer to the evaporating part E is evaporated by the heat of the heat source to a vapor. The vapor is moved to the condensing part C of the first pipe. Then the vapor can be condensed as the working fluids. Thus, the evaporating part E is a high pressure area and the condensing part C is a low pressure area. The vapor is driven by the vapor pressure difference in the first pipe 1 from the evaporating part E through the heat insulation part A to the condensing part C. The condensed working fluids are driven in the second pipe 2 to the evaporating part E by the vapor pressure difference. In other words, the working fluids are evaporated to a vapor by absorbing the heat generated by the heat source. The vapor is driven to the condensing part C of the heat pipe H by the vapor pressure difference. The vapor is condensed to liquid working fluids at the condensing part C by heat dissipation. Thus, the heat can be dissipated by this continuously liquid-gas cycle in the pipe H of the embodiment.

Additionally, because no wick structure is disposed between the first pipe 1 and the second pipe 2, it means that no wick structure is disposed at the interior sidewall of the first pipe 1 and the exterior sidewall of the second pipe 2. Thus, the liquid-gas cycle of the heat pipe H can be improved to increase the heat conducting ability of the heat pipe H. Furthermore, in the heat pipe H, the working fluids are driven by the vapor pressure to flow back and with less anti-gravity problem. Preferably, due to simple structure of the heat pipe H for easy manufacturing, the quality and the yield of the manufacturing can be increased and the cost can be decreased.

Figure 2:
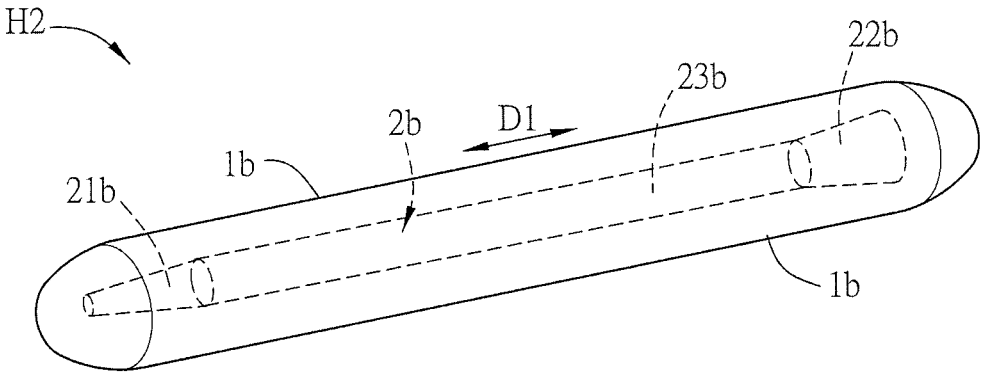
FIG. 2 is a schematic view of partial heat pipe according to an additional embodiment of the present invention.

FIG. 2 is a schematic view of partial heat pipe according to an additional embodiment of the present invention. In the embodiment, a heat pipe H2 is similar to the heat pipe H1, but differs in the configuration of a second pipe H2 and the second pipe 2. In details, the heat pipe H2 includes two ends 21*b*, 22*n* along the radial direction D1 and a middle part 23*b* disposed between the two ends 21*b*, 22*b*. A cross-sectional area of one of the two ends 21*b*, 22*b* is larger than or smaller than that of the middle part 23*b*. In the embodiment, the end 22*b* is with a converging configuration, and the cross-sectional area of the end 22*b* is larger than that of the middle part 23*b*. According to the configuration of the second pipe 2*b* of the embodiment, when the second pipe is utilized as an evaporating end (the end 21*b* in the embodiment) and is converged, it is can be prevent the vapor to flow back to the second pipe 2*b*. Thus, the heat conducting efficiency of the vapor of the first pipe 1*b* and the second pipe 2*b* can be improved. Additionally, when the second pipe 2*b* is utilized as the condensing end (the end 22*b* in the embodiment) and diverged. Accordingly, the ability that the liquids flow back to the second pipe 2*b* can be improved. Thus, the heat conducting efficiency of the vapor of the first pipe 1*b* and the second pipe 2*b* can be improved.

The two ends 21*b*, 22*b* of the second pipe 2*b* are not limited to above descriptions and drawings. In the other embodiment, the two ends 21*b*, 22*b* can respectively be a diverging configuration and a converging configuration. It just depends on the requests for applications.

Figure 3A:
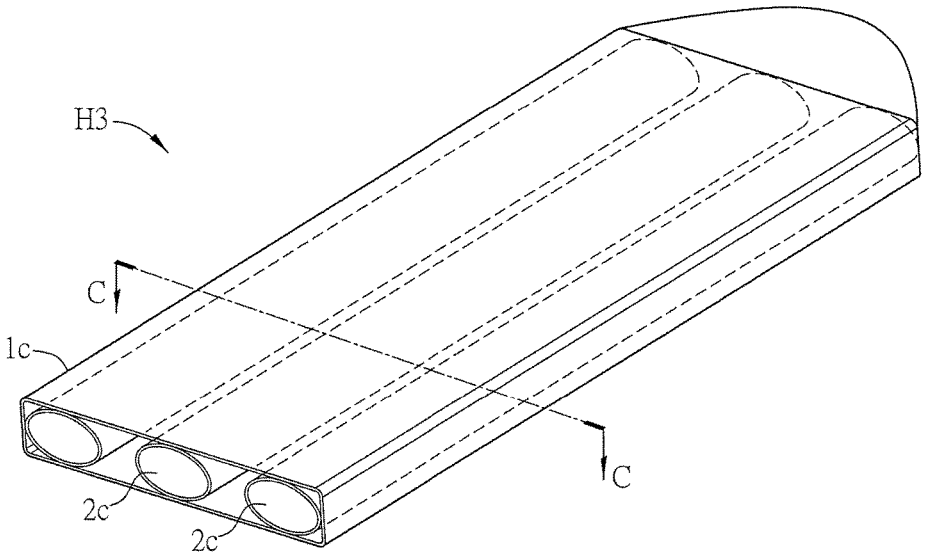
FIG. 3A is a schematic view of partial heat pipe according to an additional embodiment of the present invention.
Figure 3B:
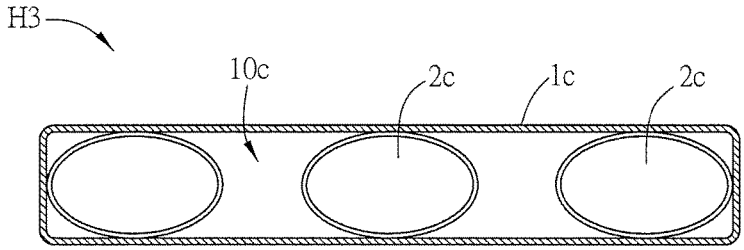
FIG. 3B is a cross-sectional view taken along line C-C of the heat pipe as shown in FIG. 3A.

FIG. 3A is a schematic view of partial heat pipe according to an additional embodiment of the present invention. FIG. 3B is a cross-sectional view taken along line C-C of the heat pipe as shown in FIG. 3A. Different from the above embodiments, a heat pipe H3 includes a plurality of second pipes 2*c*. The second pipes 2*c* are disposed in the first pipe 1*c* and adjacent to each other. According to configuration of the second pipes 2*c*, a flat heat pipe H3 with larger area can be formed. Because the heat pipe H3 of the embodiment is flattened, an inner surface of the first pipe 1*c* contacts with an exterior sidewall of the second pipe 2*c*. Thus, the second pipe 2*c* can be considered as a support structure of the heat pipe H3 for avoiding deformation.

Figure 4A:
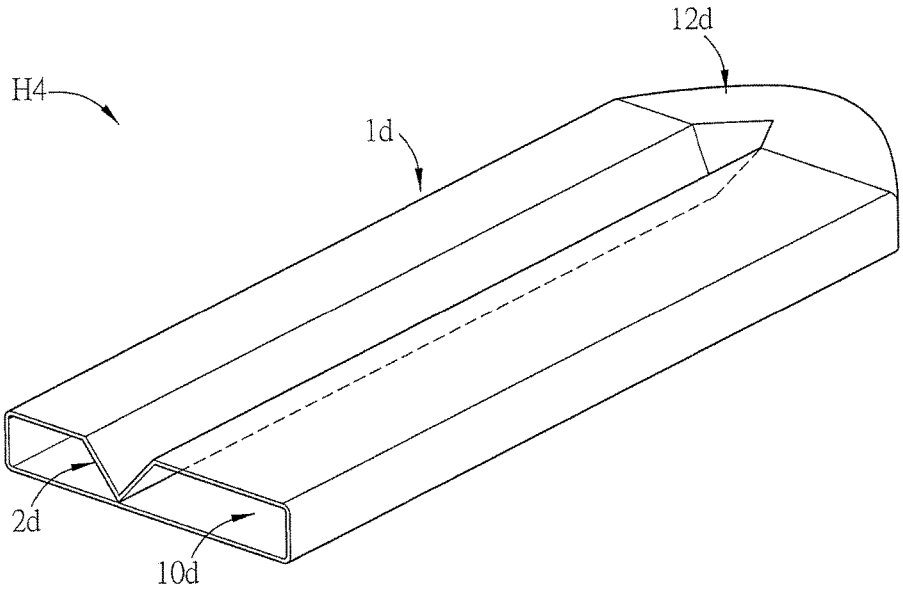
FIG. 4A is a schematic view of partial heat pipe according to an additional embodiment of the present invention.
Figure 4B:
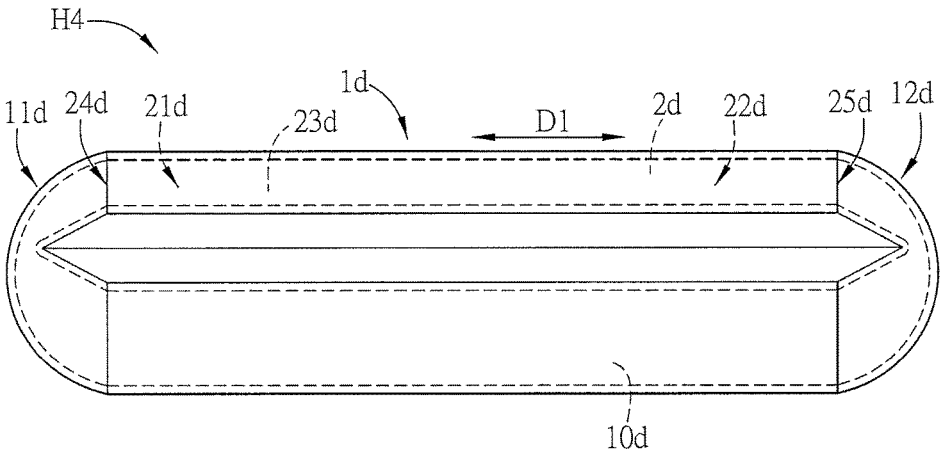
FIG. 4B is a top perspective view of the heat pipe in FIG. 4A.

FIG. 4A is a schematic view of partial heat pipe according to an additional embodiment of the present invention. FIG. 4A is a top perspective view of the heat pipe in FIG. 4A. In the embodiment, a heat pipe H4 includes a first pipe 1*d*. The first pipe 1*d* is formed with an enclosed space and no wick structure disposed at an inner sidewall of the first pipe. A part of the first pipe 1*d* is deformed and includes a first section 10*d* and a second section 2*d*. The first section 10*d* and the second section 2*d* is essentially the same as the enclosed space 10 and the second pipe 2. In other words, the second section 2*d* is formed by a part of the first section 1*d*.

In details, the second section 2*d* includes a first opening 24*d* and a second opening 25*d*. The first opening 24*d* and the second opening 25*d* are communicated with the first section, respectively. Thus, the heat pipe H4 can include the same heat dissipation system of the heat pipe H of the above embodiment. The working fluids are driven by vapor pressure to flow back in the second section 2*d* and the first section 10*d* for heat dissipation.

Furthermore, the size of the second section 2*d* is smaller than that of the first section 10*d*. It means that the size of the liquid channel (the second section 2*d*) of the heat pipe H4 is smaller than that of the vapor channel (the first section 1*d*). Thus, a better heat dissipation efficiency of the heat pipe H4 can be achieved. On the other side, the heat pipe H4 in the embodiment is formed by pressing the first pipe 1*d* to form the channels for the working fluids and the liquid-gas cycle. The process can be simplified and prevent the shift problem caused by assembling a plurality of pipes in one large pipe.

Additionally, the same parts of the heat pipe H4 and the heat pipe H2 of above embodiment are as follows. The second section 2*d* includes two ends 21*d*, 22*d* along the axial direction D1 and a middle part 23*d* between the two ends 21*d*, 22*d*. The end 21*d* includes a converging configuration (not shown). Thus, the cross-sectional area of the end 21*d* is smaller than that of the middle part 23*d*. The end 22*d* includes a diverging configuration (not shown). Thus, the cross-sectional area of the end 23*d* is larger than that of the middle part 23*d*. According to the configuration of heat pipe H4, the flowing back ability of the second section 2*d* can be improved. Thus, the heat conducting efficiency of the vapor of the first pipe 10*d* and the second pipe 2*d* can be improved.

In summary, the heat pipe of the present invention includes a first pipe and a second pipe disposed in the first pipe. Due to simple structure for easy manufacturing, the quality and the yield of the manufacturing of the heat pipe can be increased and the cost can be decreased. Additionally, the heat pipe of the present invention with inner pipe and outer pipe can improve the efficiency of the liquid-gas cycle in the heat pipe and the heat conducting ability of the heat pipe. The heat pipe of the present invention is especially for avoiding the transient heat shock and providing a solution for dissipating a lot of heat and high heat flux.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A heat pipe comprising:

a first pipe formed with an enclosed space and no wick structure disposed at an inner sidewall of the first pipe, a part of sidewall of the first pipe being deformed to define only one first section and only one second section between two opposite end sections of the first pipe, the second section comprising a first opening and a second opening, the first opening and the second opening communicated with the first section through the two opposite end sections, respectively, wherein the second section comprises two ends along an axial direction and a middle part between the two ends, the two ends respectively includes a converging configuration and a diverging configuration, a first cross-sectional area of one of the two ends is larger than that of the middle part, a second cross-section area of one of the two ends is smaller than that of the middle part, and a third cross-sectional area of the middle part remains unchanged between the two ends.

2. The heat pipe of claim 1, wherein a size of the second section is smaller than that of the first section.

* * * * *